US007195852B2

(12) United States Patent
Moudry et al.

(10) Patent No.: US 7,195,852 B2
(45) Date of Patent: Mar. 27, 2007

(54) LIQUID TONER COMPOSITIONS COMPRISING AN AMPHIPATHIC COPOLYMER COMPRISING A POLYSILOXANE MOIETY

(75) Inventors: Ronald J. Moudry, Woodbury, MN (US); James A. Baker, Hudson, WI (US)

(73) Assignee: Samsung Electronics Company, Suwon (KR)

( * ) Notice: Subject to any disclaimer, the term of this patent is extended or adjusted under 35 U.S.C. 154(b) by 447 days.

(21) Appl. No.: 10/881,007

(22) Filed: Jun. 30, 2004

(65) Prior Publication Data

US 2006/0003249 A1 Jan. 5, 2006

(51) Int. Cl.
*G03G 9/00* (2006.01)

(52) U.S. Cl. ..... 430/114; 430/137.15; 430/137.22

(58) Field of Classification Search ..... 430/114, 430/137.15, 137.22
See application file for complete search history.

(56) References Cited

U.S. PATENT DOCUMENTS

| | | | | |
|---|---|---|---|---|
| 3,411,936 | A | 11/1968 | Roteman et al. | 117/37 |
| 3,786,116 | A | 1/1974 | Milkovich et al. | 260/885 |
| 3,842,059 | A | 10/1974 | Milkovich et al. | 260/93.5 |
| 4,268,598 | A | 5/1981 | Leseman et al. | 430/107 |
| 4,413,048 | A | 11/1983 | Landa | 430/115 |
| 4,420,244 | A | 12/1983 | Landa | 335/3 |
| 4,886,726 | A | 12/1989 | Chan et al. | 430/115 |
| 5,023,159 | A | 6/1991 | Ong et al. | 430/109 |
| 5,075,352 | A | 12/1991 | Elmasry | 523/201 |
| 5,176,974 | A | 1/1993 | Till et al. | 430/42 |
| 5,283,148 | A | 2/1994 | Rao | 430/114 |
| 5,384,226 | A | 1/1995 | Kanakura et al. | 430/137 |
| 5,397,669 | A | 3/1995 | Rao | 430/108 |
| 5,420,676 | A | 5/1995 | Arcaro | 355/271 |
| 5,432,591 | A | 7/1995 | Geleynse | 355/256 |
| 5,604,070 | A | 2/1997 | Rao et al. | 430/110 |
| 5,648,190 | A | 7/1997 | Kato et al. | 430/47 |
| 5,733,698 | A | 3/1998 | Lehman et al. | 430/66 |
| 5,753,763 | A | 5/1998 | Rao et al. | 525/276 |
| 5,886,067 | A | 3/1999 | Li et al. | 523/201 |
| 5,888,491 | A | 3/1999 | Mitra et al. | 424/78.31 |
| 5,916,718 | A | 6/1999 | Kellie et al. | 430/45 |
| 5,919,866 | A | 7/1999 | Rao et al. | 525/276 |
| 6,045,956 | A | 4/2000 | Kato et al. | 430/47 |
| 6,103,781 | A | 8/2000 | Li et al. | 523/201 |
| 6,136,490 | A | 10/2000 | Ogawa et al. | 430/109 |
| 6,255,363 | B1 | 7/2001 | Baker et al. | 523/201 |
| 2004/0091805 | A1 | 5/2004 | Qian et al. | 430/109.1 |
| 2004/0091806 | A1 | 5/2004 | Qian et al. | 430/109.31 |
| 2004/0091807 | A1 | 5/2004 | Qian et al. | 430/114 |
| 2004/0091808 | A1 | 5/2004 | Qian et al. | 430/114 |
| 2004/0091809 | A1 | 5/2004 | Qian et al. | 430/114 |

FOREIGN PATENT DOCUMENTS

| | | |
|---|---|---|
| EP | 0706095 | 9/1995 |

OTHER PUBLICATIONS

Patent Abstracts of Japan, Pub. No. JP05119529, published on Oct. 30, 1991 for Japanese Patent Application No. 03284281.

*Primary Examiner*—Mark A. Chapman
(74) *Attorney, Agent, or Firm*—Kagan Binder, PLLC

(57) ABSTRACT

The invention provides liquid toner compositions in which the polymeric binder is chemically grown in the form of copolymeric binder particles dispersed in a liquid carrier. The polymeric binder includes one amphipathic copolymer comprising one or more S material portions and one or more D material portions, wherein the amphipathic copolymer comprises a polysiloxane moiety having molecular weight of at least about 500. Methods of making the liquid toner compositions are also provided.

18 Claims, No Drawings

LIQUID TONER COMPOSITIONS COMPRISING AN AMPHIPATHIC COPOLYMER COMPRISING A POLYSILOXANE MOIETY

FIELD OF THE INVENTION

The present invention relates to liquid toner compositions. More specifically, the invention relates to liquid toner compositions comprising an amphipathic copolymer that in turn comprises a polysiloxane moiety.

BACKGROUND OF THE INVENTION

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not re-useable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974.

In contrast, electrophotographic imaging processes typically involve the use of a reusable, light sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which may also be referred to as "light", may include infrared radiation, visible light, and ultraviolet radiation, for example.

In the development step, toner particles of the appropriate polarity are generally brought into contact with the latent image on the photoreceptor, typically using a developer electrically-biased to a potential having the same polarity as the toner polarity. The toner particles migrate to the photoreceptor and selectively adhere to the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The transfer of an image typically occurs by one of the following two methods: elastomeric assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative energies between the ink, a photoreceptor surface and a temporary carrier surface or medium for the toner. The effectiveness of such elastomeric assist or adhesive transfer is controlled by several variables including surface energy, temperature, pressure, and toner rheology. An exemplary elastomeric assist/adhesive image transfer process is described in U.S. Pat. No. 5,916,718.

Electrostatic assist or electrostatic transfer refers generally to a process in which transfer of an image is primarily affected by electrostatic charges or charge differential phenomena between the receptor surface and the temporary carrier surface or medium for the toner. Electrostatic transfer may be influenced by surface energy, temperature, and pressure, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high pressure with or without heat. In the cleaning step, residual toner remaining on the photoreceptor is removed. Finally, in the erasing step, the photoreceptor charge is reduced to a substantially uniformly low value by exposure to light of a particular wavelength band, thereby removing remnants of the original latent image and preparing the photoreceptor for the next imaging cycle.

Electrophotographic imaging processes may also be distinguished as being either multi-color or monochrome printing processes. Multi-color printing processes are commonly used for printing graphic art or photographic images, while monochrome printing is used primarily for printing text. Some multi-color electrophotographic printing processes use a multi-pass process to apply multiple colors as needed on the photoreceptor to create the composite image that will be transferred to the final image receptor, either by via an intermediate transfer member or directly. One example of such a process is described in U.S. Pat. No. 5,432,591.

In one exemplary electrophotographic, multi-color, multi-pass printing process, the photoreceptor takes the form of a relatively large diameter drum to permit an arrangement of two or more multi-color development stations around the circumference perimeter of the photoreceptor. Alternatively, toners of varying colors can be contained in developing units that are arranged on a moveable sled such that they can be individually moved into place adjacent to the photoreceptor as needed to develop a latent electrophotographic image. A single rotation of the photoreceptor drum generally corresponds to the development of a single color; four drum rotations and four sled movements are therefore required to develop a four color (e.g. full color) image. The multi-color image is generally built up on the photoreceptor in an overlaid configuration, and then the full color image is transferred with each color remaining in imagewise registration, to a final image receptor, either directly or via an intermediate transfer element.

In an exemplary electrophotographic, four-color, four-pass full color printing process, the steps of photoreceptor charging, exposure, and development are generally performed with each revolution of the photoreceptor drum, while the steps of transfer, fusing, cleaning, and erasure are generally performed once every four revolutions of the photoreceptor. However, multi-color, multi-pass imaging processes are known in which each color plane is transferred from the photoreceptor to an intermediate transfer element on each revolution of the photoreceptor. In these processes, the transfer, cleaning and erasure steps are generally performed upon each revolution of the photoreceptor, and the full-color image is built up on the intermediate transfer element and subsequently transferred from the intermediate transfer element to the final image receptor and fused.

Alternatively, electrophotographic imaging processes may be purely monochromatic. In these systems, there is typically only one pass per page because there is no need to overlay colors on the photoreceptor. Monochromatic processes may, however, include multiple passes where necessary to achieve higher image density or a drier image on the final image receptor, for example.

A single-pass electrophotographic process for developing multiple color images is also known and may be referred to as a tandem process. A tandem color imaging process is discussed, for example in U.S. Pat. No. 5,916,718 and U.S. Pat. No. 5,420,676. In a tandem process, the photoreceptor accepts color from developer stations that are spaced from each other in such a way that only a single pass of the photoreceptor results in application of all of the desired colors thereon.

In an exemplary four-color tandem process, each color may be applied sequentially to a photoreceptive element that travels past each developer station, overlaying each successive color plane on the photoreceptor to form the complete four-color image, and subsequently transferring the four-color image in registration to a final image receptor. For this exemplary process, the steps of photoreceptor charging, exposure, and development are generally performed four times, once for each successive color, while the steps of transfer, fusing, cleaning, and erasure are generally performed only once. After developing the four-color image on the photoreceptor, the image may be transferred directly to the final image receptor or alternatively, to an intermediate transfer member and then to a final image receptor.

In another type of multi-color tandem imaging apparatus, each individual color's developer station may include a small photoreceptor on which each color's contribution to the total image is plated. As an intermediate transfer member passes each photoreceptor, the image is transferred to the intermediate transfer member. The multi-color image is thereby assembled on the intermediate transfer element in overlaid registration of each individual colored toner layer, and subsequently transferred to the final image receptor.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically a nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

A typical toner particle for a liquid toner composition generally comprises a visual enhancement additive (for example, a colored pigment particle) and a polymeric binder. The polymeric binder fulfills functions both during and after the electrophotographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like. Exemplary liquid toners and liquid electrophotographic imaging process are described by Schmidt, S. P. and Larson, J. R. in Handbook of Imaging Materials Diamond, A. S., Ed: Marcel Dekker: New York; Chapter 6, pp 227–252.

The liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30° C. and volume mean particle diameter between 0.1–1 micron. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68–74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40° C. and volume mean particle diameter between 3–10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer.

Photoreceptors generally have a photoconductive layer that transports charge (either by an electron transfer or charge transfer mechanism) when the photoconductive layer is exposed to activating electromagnetic radiation or light. The photoconductive layer is generally affixed to an electroconductive support, such as a conductive drum or an insulative substrate that is vapor coated with aluminum or another conductor. The surface of the photoreceptor can be either negatively or positively charged so that when activating electromagnetic radiation strikes certain regions of the photoconductive layer, charge is conducted through the photoreceptor to neutralize, dissipate or reduce the surface potential in those activated regions.

An optional barrier layer may be used over the photoconductive layer to protect the photoconductive layer and thereby extend the service life of the photoconductive layer. Other layers, such as adhesive layers, priming layers, or charge injection blocking layers, are also used in some photoreceptors. These layers may either be incorporated into the photoreceptor material chemical formulation, or may be applied to the photoreceptor substrate prior to the application of the photo receptive layer or may be applied over the top of photoreceptive layer. A permanently bonded release layer may also be used on the surface of the photoreceptor to facilitate transfer of the image from the photoreceptor to either the final substrate, such as paper, or to an intermediate transfer element, particularly when an adhesive transfer process is used. U.S. Pat. No. 5,733,698 describes an exemplary permanently bonded release layer suitable for use in imaging processes using adhesive transfer.

Many electrophotographic imaging processes make use of intermediate transfer members (ITM's) to assist in transferring the developed toner image to the final image receptor. In particular, in a multipass electrophotographic process, these ITM's may contact the final image formed on the photoreceptor to assist transfer of entire image to transfer to the ITM. The image may then be transferred from the ITM to the final image receptor, typically through contact between the ITM and the final receptor.

In a tandem process, individual photoreceptors layer the images formed by the component colors on the ITM. When the entire image is composed in this manner it is typically transferred to the final image receptor. However, U.S. Pat. No. 5,432,591, for example, discloses the use of an offset roller to remove the entire image from a photoreceptor and transfer it to the final image receptor in a multi-pass liquid electrophotographic process. In various embodiments, the ITM may be an endless belt, a roller or a drum.

One continuing problem in liquid electrophotography is ensuring that the toner particles transfer efficiently from the photoreceptor, from any optional intermediate transfer member, and to the final image receptor. Frequently, a noticeable percentage of the toner layer is left behind at each transfer step, resulting in poor image quality and low optical density on the final image receptor, and toner residues on various machine surfaces that must be efficiently cleaned. The art continually searches for improved liquid toner transfer processes, and for methods and materials that allow liquid toner particles to transfer more completely, producing high quality, durable multicolor images on a final image receptor.

Liquid toners useful for electrographic or electrophotographic processes comprising a pigment and a resin comprising a polymer containing macromeric moieties are described in a patent family including U.S. Pat. Nos. 5,283,148; 5,397,669; 5,604,070; 5,753,763 and 5,919,866. The resin as described therein comprises a polymer formed from ethylenically unsaturated monomers, macromeric moieties that render the resin dispersible in hydrocarbon solvents, and a surface-release promoting moiety. The macromer as described therein comprises a carbon chain backbone having various pendant moieties, including moieties of the formula $C(O)OSi(R^{12})_3$, $C(O)O(CH_2)_n\ Si(R^{12})_3$, $(CH_2)_nSi(R^{12})_3$, $O(CH_2)_nSi(R^{12})_3$, where $R^{12}$ represents a member selected from the group consisting of alkyl, aryl, alkoxyl, trialkylsiloxy, and triarylsiloxy groups and combinations of the foregoing groups, and n represents an integer from 1 to 12, inclusive, or $CH_2R_f$, $C(O)OR_f$, $OR_f$, where $R_f$ represents a fluorinated, preferably perfluorinated, group selected from the group consisting of alkyl, aryl, alkaryl, and aralkyl groups having up to 18 carbon atoms.

SUMMARY OF THE INVENTION

Liquid electrophotographic toner compositions are provided comprising a liquid carrier having a Kauri-butanol number less than 30 mL; and a plurality of toner particles dispersed in the liquid carrier. The toner particles comprise polymeric binder comprising at least one amphipathic copolymer comprising one or more S material portions and one or more D material portions, wherein the amphipathic copolymer comprises a polysiloxane moiety having molecular weight of at least about 500. The incorporation of polysiloxane moieties surprisingly affords unique opportunities in formulation of toner compositions, whereby unique adhesion, solvation, and glass transition temperature characteristics may be obtained. The resulting toner compositions may be effectively formulated for use in either adhesive transfer or electrostatic transfer imaging processes. Additionally, the toner compositions may be formulated to provide either effective color-imparting toner compositions, or compositions useful in formation of a release layer on a photoreceptor or intermediate transfer element.

Preferably, the toner particles of the present invention are formulated to provide a liquid toner having desired release characteristics from photoreceptors and like intermediate process surfaces, and additionally having desired adhesion properties to the desired ultimate substrate of the image. Advantageously, toner compositions of the present invention can be formulated to achieve the indicated adhesion and release characteristics without the need to use pre-applied release layers and/or additionally incorporated release materials in the toner composition, and also without the need to use preapplied adhesion enhancement layers and/or additionally incorporated adhesion enhancement materials in the toner composition.

Methods of making amphipathic copolymers comprising polysiloxane moieties are also provided. In one embodiment, the polysiloxane moiety is provided as an oligomer with a polymerizable functionality and the moiety is incorporated into a copolymer formed by reaction therewith. In one aspect of this embodiment, the polysiloxane moiety is provided as a polymerizable polysiloxane oligomer with a vinyl group (and more preferably with an acrylic or methacrylic functionality), and the amphipathic copolymer is formed by reaction of acrylate and/or methacrylate monomers together with the polymerizable polysiloxane oligomer in a "single pot" reaction. Because the polysiloxane moiety is soluble in preferred liquid carriers of the ultimate toner composition, the polysiloxane moiety is the S portion of the amphipathic copolymer. Alternatively, an S portion (or a D portion) of the amphipathic copolymer may be formed by reaction of selected acrylate and/or methacrylate monomers together with the polymerizable polysiloxane oligomer, with subsequent grafting of a complementary D portion (or S portion) to form the amphipathic copolymer.

In another embodiment of a method for making amphipathic copolymers comprising polysiloxane moieties, an amphipathic copolymer is formed comprising an S portion and a D portion and also comprising a reactive functionality. The polysiloxane moiety is provided as an oligomer with a functionality that is reactive with the reactive functionality of the amphipathic copolymer, and the polysiloxane moiety is grafted onto the amphipathic copolymer by reaction of the reactive functionalities.

In all of the above methods, the polymerizable functionality or the reactive functionality, as the case may be, may optionally be located at either the middle or at an end of the copolymer or polysiloxane moiety.

The liquid electrophotographic toner compositions of the present invention in one aspect preferably may be formulated for use as transfer assist compositions. Such toner compositions form a transfer assist layer that may have release properties under certain process conditions, so that the transfer assist layer does not adhere to a photoreceptor or to an intermediate transfer belt or the like in order to facilitate an image transfer process. A transfer assist layer may also have unique benefits in providing a protective and/or image enhancing layer over the top of an image formed using toner compositions.

DETAILED DESCRIPTION OF PRESENTLY PREFERRED EMBODIMENTS

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

As used herein, the term "amphipathic" refers to a copolymer having a combination of portions having distinct solubility and dispersibility characteristics in a desired liquid carrier that is used to make the copolymer and/or used in the course of preparing the liquid toner particles. Preferably, the liquid carrier (also sometimes referred to as "carrier liquid") is selected such that at least one portion (also referred to herein as S material or block(s)) of the copolymer is more solvated by the carrier while at least one other portion (also referred to herein as D material or block(s)) of the copolymer constitutes more of a dispersed phase in the carrier.

In preferred embodiments, the copolymer is polymerized in situ in the desired liquid carrier, as this yields substantially monodisperse copolymeric particles suitable for use in toner compositions. The resulting organosol is then preferably mixed with at least one visual enhancement additive and optionally one or more other desired ingredients to form a liquid toner. During such combination, ingredients comprising the visual enhancement particles and the copolymer will tend to self-assemble into composite particles having solvated (S) portions and dispersed (D) portions. Specifically, it is believed that the D material of the copolymer will tend to physically and/or chemically interact with the surface of the visual enhancement additive, while the S material helps promote dispersion in the carrier.

Preferably, the nonaqueous liquid carrier of the organosol is selected such that at least one portion (also referred to herein as the S material or portion) of the amphipathic copolymer is more solvated by the carrier while at least one other portion (also referred to herein as the D material or portion) of the copolymer constitutes more of a dispersed phase in the carrier. In other words, preferred copolymers of the present invention comprise S and D material having respective solubilities in the desired liquid carrier that are sufficiently different from each other such that the S blocks tend to be more solvated by the carrier while the D blocks tend to be more dispersed in the carrier. More preferably, the S blocks are soluble in the liquid carrier while the D blocks are insoluble. In particularly preferred embodiments, the D material phase separates from the liquid carrier, forming dispersed particles.

From one perspective, the polymer particles when dispersed in the liquid carrier may be viewed as having a core/shell structure in which the D material tends to be in the core, while the S material tends to be in the shell. The S material thus functions as a dispersing aid, steric stabilizer or graft copolymer stabilizer, to help stabilize dispersions of the copolymer particles in the liquid carrier. Consequently, the S material may also be referred to herein as a "graft stabilizer." The core/shell structure of the binder particles tends to be retained when the particles are dried when incorporated into liquid toner particles.

The solubility of a material, or a portion of a material such as a copolymeric portion, may be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H\text{-}RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters,* 2d Ed. CRC Press, Boca Raton, Fla., (1991), for monomers and representative polymers in *Polymer Handbook,* 3rd Ed., J. Brandrup & E. H. Immergut, Eds. John Wiley, N.Y., pp 519–557 (1989), and for many commercially available polymers in Barton, A. F. M., *Handbook of Polymer-Liquid Interaction Parameters and Solubility Parameters*, CRC Press, Boca Raton, Fla., (1990).

The degree of solubility of a material, or portion thereof, in a liquid carrier may be predicted from the absolute difference in Hildebrand solubility parameters between the material, or portion thereof, and the liquid carrier. A material, or portion thereof, will be fully soluble or at least in a highly solvated state when the absolute difference in Hildebrand solubility parameter between the material, or portion thereof, and the liquid carrier is less than approximately 1.5 $MPa^{1/2}$. On the other hand, when the absolute difference between the Hildebrand solubility parameters exceeds approximately 3.0 $MPa^{1/2}$, the material, or portion thereof, will tend to phase separate from the liquid carrier, forming a dispersion. When the absolute difference in Hildebrand solubility parameters is between 1.5 $MPa^{1/2}$ and 3.0 $MPa^{1/2}$, the material, or portion thereof, is considered to be weakly solvatable or marginally insoluble in the liquid carrier. Consequently, in preferred embodiments, the absolute difference between the respective Hildebrand solubility parameters of the S portion(s) of the copolymer and the liquid carrier is less than 3.0 $MPa^{1/2}$, preferably less than about 2.0 $MPa^{1/2}$, more preferably less than about 1.5 $MPa^{1/2}$. In a particularly preferred embodiment of the present invention, the absolute difference between the respective Hildebrand solubility parameters of the S portion(s) of the copolymer and the liquid carrier is from about 2 to about 3.0 $MPa^{1/2}$.

Additionally, it is also preferred that the absolute difference between the respective Hildebrand solubility parameters of the D portion(s) of the copolymer and the liquid carrier is greater than 2.3 $MPa^{1/2}$, preferably greater than about 2.5 $MPa^{1/2}$, more preferably greater than about 3.0 $MPa^{1/2}$, with the proviso that the difference between the respective Hildebrand solubility parameters of the S and D portion(s) is at least about 0.4 $MPa^{1/2}$, more preferably at least about 1.0 $MPa^{1/2}$. Because the Hildebrand solubility of a material may vary with changes in temperature, such solubility parameters are preferably determined at a desired reference temperature such as at 25° C.

Those skilled in the art understand that the Hildebrand solubility parameter for a copolymer, or portion thereof, may be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters*, CRC Press, Boca Raton, p 12 (1990). The magnitude of the Hildebrand solubility parameter for polymeric materials is also known to be weakly dependent upon the weight average molecular weight of the polymer, as noted in Barton, pp 446–448. Thus, there will be a preferred molecular weight range for a given polymer or portion thereof in order to achieve desired solvating or dispersing characteristics. Similarly, the Hildebrand solubility parameter for a mixture may be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the Polymer Handbook, 3rd Ed., J. Brandrup & E. H. Immergut, Eds. John Wiley, N.Y., (1989). We have chosen this method for defining our invention to avoid ambiguities which could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table I lists Hildebrand solubility parameters for some common solvents used in an electrophotographic toner and the Hildebrand solubility parameters and glass transition temperatures (based on their high molecular weight homopolymers) for some common monomers used in synthesizing organosols.

TABLE I

Hildebrand Solubility Parameters
Solvent Values at 25° C.

| Solvent Name | Kauri-Butanol Number by ASTM Method D1133- 54T (ml) | Hildebrand Solubility Parameter ($MPa^{1/2}$) |
|---|---|---|
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |
| Isopar ™ G | 28 | 14.60 |
| Exxsol ™ D80 | 28 | 14.60 |

Monomer Values at 25° C.

| Monomer Name | Hildebrand Solubility Parameter ($MPa^{1/2}$) | Glass Transition Temperature (° C.)* |
|---|---|---|
| 3,3,5-Trimethyl Cyclohexyl Methacrylate | 16.73 | 125 |
| Isobornyl Methacrylate | 16.90 | 110 |
| Isobornyl Acrylate | 16.01 | 94 |
| n-Behenyl acrylate | 16.74 | <−55 (58 m.p.)** |
| n-Octadecyl Methacrylate | 16.77 | −100 (28 m.p.)** |
| n-Octadecyl Acrylate | 16.82 | −55 (42 m.p.)** |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| t-Butyl Methacrylate | 17.16 | 107 |
| n-Butyl Methacrylate | 17.22 | 20 |
| n-Hexyl Acrylate | 17.30 | −60 |
| n-Butyl Acrylate | 17.45 | −55 |
| Ethyl Methacrylate | 17.62 | 65 |
| Ethyl Acrylate | 18.04 | −24 |
| Methyl Methacrylate | 18.17 | 105 |
| Styrene | 18.05 | 100 |

Source: Calculated from equation #31 of Polymer Handbook, 3rd Ed., J. Brandrup E. H. Immergut, Eds. John Wiley, NY, p. VII/522 (1989). Calculated using Small's Group Contribution Method, Small, P.A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).
*Polymer Handbook, 3rd Ed., J. Brandrup E. H. Immergut, Eds., John Wiley, NY, pp. VII/209–277 (1989). The $T_g$ listed is for the homopolymer of the respective monomer.
**m.p. refers to melting point for selected Polymerizable Crystallizable Compounds.

The liquid carrier is a substantially nonaqueous solvent or solvent blend. In other words, only a minor component (generally less than 25 weight percent) of the liquid carrier comprises water. Preferably, the substantially nonaqueous liquid carrier comprises less than 20 weight percent water, more preferably less than 10 weight percent water, even more preferably less than 3 weight percent water, most preferably less than one weight percent water.

The carrier liquid may be selected from a wide variety of materials, or combination of materials, which are known in the art, but preferably has a Kauri-butanol number less than 30 ml. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, NJ), and most preferred carriers are the aliphatic hydrocarbon solvent blends such as Norpar™ 12, Norpar™ 13 and Norpar™ 15 (available from Exxon Corporation, NJ). Particularly preferred carrier liquids have a Hildebrand solubility parameter of from about 13 to about 15 $MPa^{1/2}$.

The liquid carrier of the toner compositions of the present invention is preferably the same liquid as used as the solvent for preparation of the amphipathic copolymer. Alternatively, the polymerization may be carried out in any appropriate solvent, and a solvent exchange may be carried out to provide the desired liquid carrier for the toner composition.

As used herein, the term "copolymer" encompasses both oligomeric and polymeric materials, and encompasses polymers incorporating two or more monomers. As used herein, the term "monomer" means a relatively low molecular weight material (i.e., generally having a molecular weight less than about 500 Daltons) having one or more polymerizable groups. "Oligomer" means a relatively intermediate sized molecule incorporating two or more monomers and generally having a molecular weight of from about 500 up to about 10,000 Daltons. "Polymer" means a relatively large material comprising a substructure formed two or more monomeric, oligomeric, and/or polymeric constituents and generally having a molecular weight greater than about 10,000 Daltons. The term "macromer" or "macromonomer" refers to an oligomer or polymer having a terminal polymerizable moiety. "The term "molecular weight" as used throughout this specification means weight average molecular weight unless expressly noted otherwise.

The weight average molecular weight of the amphipathic copolymer of the present invention may vary over a wide range, and may impact imaging performance. The polydispersity of the copolymer also may impact imaging and transfer performance of the resultant liquid toner material. Because of the difficulty of measuring molecular weight for an amphipathic copolymer, the particle size of the dispersed copolymer (organosol) may instead be correlated to imaging and transfer performance of the resultant liquid toner material. Generally, the volume mean particle diameter ($D_v$) of the dispersed graft copolymer particles, determined by laser diffraction particle size measurement, should be in the range 0.1–100 microns, more preferably 0.5–50 microns, even more preferably 1.0–20 microns, and most preferably 2–10 microns.

In addition, a correlation exists between the molecular weight of the solvatable or soluble S portion of the graft copolymer, and the imaging and transfer performance of the resultant toner. Generally, the S portion of the copolymer has a weight average molecular weight in the range of about 1000 to about 1,000,000 Daltons, preferably about 5000 to about 400,000 Daltons, more preferably about 50,000 to about 300,000 Daltons. It is also generally desirable to maintain the polydispersity (the ratio of the weight-average molecular weight to the number average molecular weight) of the S portion of the copolymer below 15, more preferably below 5, most preferably below 2.5. It is a distinct advantage of the present invention that copolymer particles with such lower polydispersity characteristics for the S portion are easily made in accordance with the practices described herein, particularly those embodiments in which the copolymer is formed in the liquid carrier in situ.

The relative amounts of S and D portions in a copolymer can impact the solvating and dispersibility characteristics of these portions. For instance, if too little of the S portion(s) are present, the copolymer may have too little stabilizing effect to sterically-stabilize the organosol with respect to aggregation as might be desired. If too little of the D portion(s) are present, there may be insufficient driving force to form a distinct particulate, dispersed phase in the liquid carrier. The presence of both a solvated and dispersed phase helps the ingredients of particles self assemble in situ with exceptional uniformity among separate particles. Balancing these concerns, the preferred weight ratio of D material to S material (i.e. core/shell ratio) is in the range of 1:20 to 20:1, preferably 1:1 to 15:1, more preferably 2:1 to 10:1, and most preferably 4:1 to 8:1.

Glass transition temperature, $T_g$, refers to the temperature at which a (co)polymer, or portion thereof, changes from a hard, glassy material to a rubbery, or viscous, material, corresponding to a dramatic increase in free volume as the (co)polymer is heated. The $T_g$ can be calculated for a (co)polymer, or portion thereof, using known $T_g$ values for the high molecular weight homopolymers (see, e.g., Table I herein) and the Fox equation expressed below:

$$1/T_g = w_1/T_{g1} + w_2/T_{g2} + \ldots w_i/T_{gi}$$

wherein each $w_n$ is the weight fraction of monomer "n" and each $T_{gn}$ is the absolute glass transition temperature (in degrees Kelvin) of the high molecular weight homopolymer of monomer "n" as described in Wicks, A. W., F. N. Jones & S. P. Pappas, Organic Coatings 1, John Wiley, NY, pp 54–55 (1992).

In the practice of the present invention, values of $T_g$ for the D or S portion of the copolymer were determined using the Fox equation above, although the $T_g$ of the copolymer as a whole may be determined experimentally using e.g. differential scanning calorimetry. The glass transition temperatures ($T_g$'s) of the S and D portions may vary over a wide range and may be independently selected to enhance manufacturability and/or performance of the resulting liquid toner particles. The $T_g$'s of the S and D portions will depend to a large degree upon the type of monomers constituting such portions. Consequently, to provide a copolymer material with higher $T_g$, one can select one or more higher $T_g$ monomers with the appropriate solubility characteristics for the type of copolymer portion (D or S) in which the monomer(s) will be used. Conversely, to provide a copolymer material with lower $T_g$, one can select one or more lower $T_g$ monomers with the appropriate solubility characteristics for the type of portion in which the monomer(s) will be used.

As noted above, polysiloxane moieties are provided in the amphipathic copolymer. Preferably, the polysiloxane moiety comprises from about 3 to about 35% by weight of the solids portion of the toner composition. More preferably, the polysiloxane moiety comprises from about 10 to about 30%, and most preferably from about 15 to about 25%, by weight of the solids portion of the toner composition.

The polysiloxane moiety preferably has a molecular weight of from about 10,000 to about 1,000,000 Daltons, and more preferably from about 30,000 to about 500,000 Daltons.

The polysiloxane moiety in one embodiment of the present invention is the major component of the S portion of the amphipathic copolymer. Thus, due to its solubility in the preferred carrier liquids of the toner compositions, the polysiloxane moiety may provide the majority of the solvating function of the amphipathic copolymer of the binder. In a preferred embodiment of the present invention, no other components that meet the solubility criteria to be described as a soluble homopolymers as discussed herein are present in the amphipathic copolymer. In this embodiment, it can be said that the polysiloxane moiety is the S portion of the amphipathic copolymer.

In an alternative preferred embodiment, the polysiloxane moiety is in the D material of the amphipathic copolymer. In this embodiment, the relative amount of polysiloxane moiety in comparison to the other components of the D portion of the amphipathic copolymer is low, so as not to adversely affect the solubility characteristics of the D portion and thereby prevent development of the unique self-assembled particulate nature of the binder polymer.

In a preferred embodiment of the present invention, the polysiloxane moiety has a structure $$—Si(R)_{3-m}Z_m$$

where R is hydrogen, lower alkyl (e.g., 1 to 4 carbon atoms, methyl, ethyl, or propyl), aryl (e.g., 6 to 20 carbon atoms, phenyl or substituted phenyl), or alkoxy (preferably lower alkoxy of 1 to 4 carbon atoms);

m is an integer of from 1 to 3;

and Z is a monovalent siloxane polymeric moiety having a number average molecular weight above about 500 and is essentially unreactive under copolymerization conditions.

The polysiloxane moiety may be incorporated in the amphipathic copolymer in any desired manner. For example, the polysiloxane moiety may be provided as a reactive macromer that is copolymerized with selected monomers to form the amphipathic copolymer. Alternatively, the polysiloxane moiety may be provided as a reactive macromer that is grafted onto an existing reactive prepolymer to form the amphipathic copolymer.

The polysiloxane moiety preferably is derived from an ethylenically unsaturated organosiloxane chain.

A preferred example of an ethylenically unsaturated organosiloxane chain that is a polymerizable polysiloxane moiety is a macromer having the general formula $$X(Y)_nSi(R)_{3-m}Z_m$$

wherein

X is a vinyl group that is copolymerizable with acrylate or methacrylate functionalities;

Y is a divalent linking group (e.g., alkylene, arylene, alkarylene, and aralkylene of 1 to 30 carbon atoms) and incorporating heteroatoms e.g. O, N, S, P. Examples are ester, amide, urethane, urea groups;

n is zero or 1; m is an integer of from 1 to 3; R is hydrogen, lower alkyl (e.g., 1 to 4 carbon atoms, methyl, ethyl, or propyl), aryl (e.g., 6 to 20 carbon atoms, phenyl or substituted phenyl), or alkoxy (preferably lower alkoxy of 1 to 4 carbon atoms);

and Z is a monovalent siloxane polymeric moiety having a number average molecular weight above about 500 and is essentially unreactive under copolymerization conditions.

A particularly preferred polymerizable polysiloxane moiety is a macromer of the above formula, further defined as having an X group which has the general formula

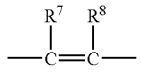

wherein $R^7$ is a hydrogen atom or a COOH group and $R^8$ is a hydrogen atom, a methyl group, or a $CH_2COOH$ group;

Y is a group of the formula —C(O)O—;

and Z has the general formula

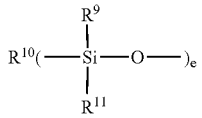

where $R^9$ and $R^{11}$ are independently lower alkyl, aryl, or fluoroalkyl, where lower alkyl and fluoroalkyl both refer to alkyl groups having from one to three carbon atoms and where aryl refers to phenyl or substituted phenyl (of up to 20 carbon atoms). $R^{10}$ may be alkyl (of 1 to 20 carbon atoms), alkoxy (of 1 to 20 carbon atoms), alkylamino (of 1 to 20 carbon atoms), aryl (of up to 20 carbon atoms), hydroxyl, or fluoroalkyl (of 1 to 20 carbon atoms), and e is an integer from about 5 to about 700.

In a preferred method, a liquid electrophotographic toner composition may be prepared by providing a macromer having the general formula $$X(Y)_nSi(R)_{3-m}Z_m$$

wherein

X is a vinyl group that is copolymerizable with acrylate or methacrylate functionalities, Y is a divalent linking group, n is zero or 1, m is an integer of from 1 to 3, R is hydrogen, lower alkyl, aryl, or alkoxy, and Z is a monovalent siloxane polymeric moiety having a number average molecular weight above about 500 and is essentially unreactive under copolymerization conditions.

This macromer may be reacted with (meth)acrylate monomers to form polymeric binder particles comprising at least one amphipathic copolymer comprising one or more S material portions and one or more D material portions, wherein the amphipathic copolymer comprises a polysiloxane moiety having molecular weight of at least about 500 Daltons.

Particularly preferred macromers to be used in this process are selected from macromers having an X group which has the general formula

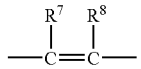

wherein $R^7$ is a hydrogen atom or a COOH group and $R^8$ is a hydrogen atom, a methyl group, or a $CH_2COOH$ group;

Y is a group of the formula —C(O)O—;

and Z has the general formula

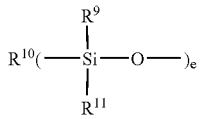

where $R^9$ and $R^{11}$ are independently lower alkyl, aryl, or fluoroalkyl, where lower alkyl and fluoroalkyl both refer to alkyl groups having from one to three carbon atoms and where aryl refers to phenyl or substituted phenyl;

$R^{10}$ is alkyl, alkoxy, alkylamino, aryl, hydroxyl, or fluoroalkyl;

and e is an integer from about 5 to about 700.

Toner particles may be formed from the resulting polymeric binder particles. A liquid toner composition may then be formed comprising a liquid carrier having a Kauri-butanol number less than 30 mL (either using the reaction solvent or by solvent exchange) and a plurality of the toner particles.

Alternatively, the polysiloxane moiety may be added to an existing prepolymer using grafting techniques as discussed in more detail below. For example, in a preferred process a prepolymer may be provided that comprises a reactive functionality. A macromer is also provided that has the general formula $$A\text{-}Si(R)_{3-m}Z_m$$

wherein

A is a complementary reactive functionality that is reactive with the reactive functionality of the prepolymer described above, m is an integer of from 1 to 3, R is hydrogen, lower alkyl, aryl, or alkoxy, and Z is a monovalent siloxane polymeric moiety having a number average molecular weight above about 500 and is essentially unreactive under copolymerization conditions.

The prepolymer may be reacted with the macromer to form polymeric binder particles comprising at least one amphipathic copolymer comprising one or more S material portions and one or more D material portions, wherein the amphipathic copolymer comprises a polysiloxane moiety having molecular weight of at least about 500 Daltons. Toner particles may be formed from the resulting polymeric binder particles. A liquid toner composition may then be formed comprising a liquid carrier having a Kauri-butanol number less than 30 mL (either using the reaction solvent or by solvent exchange) and a plurality of the toner particles.

Macromers used to provide the polysiloxane moiety are preferably terminally functional polymers having a single functional group (vinyl, ethylenically unsaturated, acryloyl, or methacryloyl group). Such macromers are known and may be prepared by the method disclosed by Milkovich et al., as described in U.S. Pat. Nos. 3,786,116 and 3,842,059. The preparation of polydimethylsiloxane macromonomer and subsequent copolymerization with vinyl monomer have been described in several papers by Y. Yamashita et al., [Polymer J. 14, 913 (1982); ACS Polymer Preprints 25 (1), 245 (1984); Makromol. Chem. 185, 9 (1984)]. This method of macromonomer preparation involves the anionic polymerization of hexamethylcyclotrisiloxane monomer ($D_3$) to form living polymer of controlled molecular weight, and termination is achieved via chlorosilane compounds containing a polymerizable vinyl group. Free radical copolymerization of the monofunctional siloxane macromonomer with vinyl monomer or monomers provides siloxane-grafted copolymer of well-defined structure, i.e., controlled length and number of grafted siloxane branches.

Suitable monomers for use in the above-mentioned anionic polymerization are, in general, diorganocyclosiloxanes of the formula

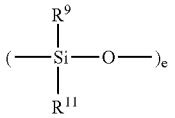

where $R^9$ and $R^{11}$ are as previously defined and where e is an integer of 3 to 7. Preferred are the cyclic siloxanes where e is 3, 4, or 5 and $R^9$ and $R^{11}$ are both methyl, these cyclic siloxanes being hereafter designated $D_3$, $D_4$ and $D_5$ respectively. $D_3$, which is a strained ring structure, is especially preferred.

Initiators of the anionic polymerization are chosen such that monofunctional living polymer is produced. Suitable initiators include alkali metal hydrocarbons such as alkyl or aryl lithium, sodium, or potassium compounds containing up to 20 carbon atoms in the alkyl or aryl radical or more, preferably up to 8 carbon atoms. Examples of such compounds are ethylsodium, propylsodium, phenylsodium, butylpotassium, octylpotassium, methyllithium, ethyllithium, n-butyllithium, sec-butyllithium, tert-butyllithium, phenyllithium, and 2-ethylhexyllithium. Lithium compounds are preferred as initiators. Also suitable as initiators are alkali metal alkoxides, hydroxides, and amides, as well as triorganosilanolates of the formula

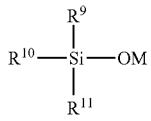

where M is alkali metal, tetraalkylammonium, or tetraalkylphosphonium cation and where $R^9$, $R^{10}$, and $R^{11}$ are as previously defined. The preferred triorganosilanolate initiator is lithium trimethylsilanolate (LTMS). In general, the preferred use of both strained cyclic monomer and lithium initiator reduces the likelihood of redistribution reactions and thereby provides siloxane macromonomer of narrow molecular weight distribution which is reasonably free of unwanted cyclic oligomers.

Molecular weight is determined by the initiator/cyclic monomer ratio, and thus the amount of initiator may vary from about 0.004 to about 0.4 mole of organometallic initiator per mole of monomer. Preferably, the amount will be from about 0.008 to about 0.04 mole of initiator per mole of monomer.

For the initiation of the anionic polymerization, an inert, preferably polar organic solvent can be utilized. Anionic polymerization propagation with lithium counterion requires either a strong polar solvent such as tetrahydrofuran, dimethyl sulfoxide, or hexamethylphosphorous triamide, or a mixture of such polar solvent with nonpolar aliphatic, cycloaliphatic, or aromatic hydrocarbon solvent such as hexane, heptane, octane, cyclohexane, or toluene. The polar solvent serves to "activate" the silanolate ion, making propagation possible. Generally, the polymerization can be carried out at a temperature ranging from about −50° C. to about 100° C., preferably from about −20° C. to about 30° C. Anhydrous conditions and an inert atmosphere such as nitrogen, helium, or argon are required.

Termination of the anionic polymerization is, in general, achieved via direct reaction of the living polymeric anion with halogen-containing termination agents, i.e., functionalized chlorosilanes, to produce vinyl-terminated polymeric monomers. Such terminating agents may be represented by the general formula $X(Y)_nSi(R)_{3-m}Cl_m$, where m is 1, 2, or 3 and where X, Y, n, and R have been previously defined. A preferred terminating agent is methacryloxypropyldimethylchlorosilane. The termination reaction is carried out by adding a slight molar excess of the terminating agent (relative to the amount of initiator) to the living polymer at the polymerization temperature. According to the aforementioned papers by Y. Yamashita et al., the reaction mixture may be ultrasonically irradiated after addition of the terminating agent in order to enhance functionality of the macromonomer. Purification of the macromonomer can be effected by addition of methanol.

A wide variety of one or more different monomeric, oligomeric and/or polymeric materials may be independently incorporated into the S and D portions, as desired. Representative examples of suitable materials include free radically polymerized material (also referred to as vinyl copolymers or (meth) acrylic copolymers in some embodiments), polyurethanes, polyester, epoxy, polyamide, polyimide, polysiloxane, fluoropolymer, polysulfone, combinations of these, and the like. Preferred S and D portions are derived from free radically polymerizable material. In the practice of the present invention, "free radically polymerizable" refers to monomers, oligomers, and/or polymers having functionality directly or indirectly pendant from a monomer, oligomer, or polymer backbone (as the case may be) that participate in polymerization reactions via a free radical mechanism. Representative examples of such functionality include (meth)acrylate groups, olefinic carbon-carbon double bonds, allyloxy groups, alpha-methyl styrene groups, (meth)acrylamide groups, cyanate ester groups, vinyl ether groups, combinations of these, and the like. The term "(meth)acryl", or variants thereof as used herein, encompasses acryl and/or methacryl.

Free radically polymerizable monomers, oligomers, and/or polymers are advantageously used to form the copolymer in that so many different types are commercially available and may be selected with a wide variety of desired characteristics that help provide one or more desired performance characteristics. Free radically polymerizable monomers, oligomers, and/or monomers suitable in the practice of the present invention may include one or more free radically polymerizable moieties.

Representative examples of monofunctional, free radically polymerizable monomers include styrene, alpha-methylstyrene, substituted styrene, vinyl esters, vinyl ethers, N-vinyl-2-pyrrolidone, (meth)acrylamide, vinyl naphthalene, alkylated vinyl naphthalenes, alkoxy vinyl naphthalenes, N-substituted (meth)acrylamide, octyl (meth)acrylate, nonylphenol ethoxylate (meth)acrylate, N-vinyl pyrrolidone, isononyl (meth)acrylate, isobornyl (meth)acrylate, 2-(2-ethoxyethoxy)ethyl (meth)acrylate, 2-ethylhexyl (meth)acrylate, beta-carboxyethyl (meth)acrylate, isobutyl (meth)acrylate, cycloaliphatic epoxide, alpha-epoxide, 2-hydroxyethyl (meth)acrylate, (meth)acrylonitrile, maleic anhydride, itaconic acid, isodecyl (meth)acrylate, lauryl (dodecyl) (meth)acrylate, stearyl (octadecyl) (meth)acrylate, behenyl (meth)acrylate, n-butyl (meth)acrylate, methyl (meth)acrylate, ethyl (meth)acrylate, hexyl (meth)acrylate, (meth)acrylic acid, N-vinylcaprolactam, stearyl (meth)acrylate, hydroxy functional caprolactone ester (meth)acrylate, isooctyl (meth)acrylate, hydroxyethyl (meth)acrylate, hydroxymethyl (meth)acrylate, hydroxypropyl (meth)acrylate, hydroxyisopropyl (meth)acrylate, hydroxybutyl (meth) acrylate, hydroxyisobutyl (meth)acrylate, tetrahydrofurfuryl (meth)acrylate, isobornyl (meth)acrylate, glycidyl (meth) acrylate vinyl acetate, combinations of these, and the like.

Nitrile functionality may be advantageously incorporated into the copolymer for a variety of reasons, including improved durability, enhanced compatibility with visual enhancement additive(s), e.g., colorant particles, and the like. In order to provide a copolymer having pendant nitrile groups, one or more nitrile functional monomers can be used. Representative examples of such monomers include (meth)acrylonitrile, β-cyanoethyl-(meth)acrylate, 2-cyanoethoxyethyl (meth)acrylate, p-cyanostyrene, p-(cyanomethyl)styrene, N-vinylpyrrolidinone, and the like.

In order to provide a copolymer having pendant hydroxyl groups, one or more hydroxyl functional monomers can be used. Pendant hydroxyl groups of the copolymer not only facilitate dispersion and interaction with the pigments in the formulation, but also promote solubility, cure, reactivity with other reactants, and compatibility with other reactants. The hydroxyl groups can be primary, secondary, or tertiary, although primary and secondary hydroxyl groups are preferred. When used, hydroxy functional monomers constitute from about 0.5 to 30, more preferably 1 to about 25 weight percent of the monomers used to formulate the copolymer, subject to preferred weight ranges for graft copolymers noted below.

Representative examples of suitable hydroxyl functional monomers include an ester of an α, β-unsaturated carboxylic acid with a diol, e.g., 2-hydroxyethyl (meth)acrylate, or 2-hydroxypropyl (meth)acrylate; 1,3-dihydroxypropyl-2-(meth)acrylate; 2,3-dihydroxypropyl-1-(meth)acrylate; an adduct of an α, β-unsaturated carboxylic acid with caprolactone; an alkanol vinyl ether such as 2-hydroxyethyl vinyl ether; 4-vinylbenzyl alcohol; allyl alcohol; p-methylol styrene; or the like.

For copolymers useful in liquid toner applications, the copolymer $T_g$ preferably should not be too low or else receptors printed with the toner may experience undue blocking. Conversely, the minimum fusing temperature required to soften or melt the toner particles sufficient for them to adhere to the final image receptor will increase as the copolymer $T_g$ increases. Consequently, it is preferred that the $T_g$ of the copolymer be far enough above the expected maximum storage temperature of a printed receptor so as to avoid blocking issues, yet not so high as to require fusing temperatures approaching the temperatures at which the final image receptor may be damaged, e.g. approaching the autoignition temperature of paper used as the final image receptor.

In a preferred embodiment of the present invention, the copolymer has a $T_g$ of less than about 30° C. to provide a toner composition that is readily used in adhesive transfer applications. Preferably, the toner composition additionally exhibits release properties to be used in adhesive transfer conditions as a transfer assist layer. In an alternative embodiment, the copolymer has a $T_g$ of 25°–100° C., more preferably 30°–80° C., most preferably 40°–70° C.

In one embodiment of the present invention, the toner composition may be formulated to form a layer that has a tacky surface. In this embodiment, the $T_g$ of the copolymer preferably is lower than about 35° C. and could be below about −10° C.

For copolymers in which the D portion comprises a major portion of the copolymer, the $T_g$ of the D portion will dominate the $T_g$ of the copolymer as a whole. For such copolymers useful in liquid toner applications, it is preferred that the $T_g$ of the D portion be less than about 30° C. when the toner composition is to be used in adhesive transfer applications, and fall in the range of 30°–105° C., more preferably 40°–95° C., most preferably 50°–85° C. when the toner composition is to be used in electrostatic transfer applications.

Blocking with respect to the S portion material is not as significant an issue inasmuch as preferred copolymers comprise a majority of the D portion material. Consequently, the $T_g$ of the D portion material will dominate the effective $T_g$ of the copolymer as a whole. However, if the $T_g$ of the S portion is too low, then the particles might tend to aggregate. On the other hand, if the $T_g$ is too high, then the requisite fusing temperature may be too high. Balancing these concerns, the S portion material is preferably formulated to have a $T_g$ of at least 0° C., preferably at least 20° C., more preferably at least 40° C. In this regard, incorporation of a polymerizable crystallizable compound (PCC) in the S portion of the copolymer will generally permit use of a lower S portion $T_g$. It is understood that the requirements imposed on the self-fixing characteristics of a liquid toner will depend to a great extent upon the nature of the imaging process. For example, rapid self-fixing of the toner to form a cohesive film may not be required or even desired in an electrographic imaging process if the image is not subsequently transferred to a final receptor, or if the transfer is effected by means (e.g. electrostatic transfer) not requiring a film formed toner on a temporary image receptor (e.g. a photoreceptor).

Preferred copolymers of the present invention may be formulated with one or more radiation curable monomers or combinations thereof that help the free radically polymerizable compositions and/or resultant cured compositions to satisfy one or more desirable performance criteria. For example, in order to promote hardness and abrasion resistance, a formulator may incorporate one or more free radically polymerizable monomer(s) (hereinafter "high $T_g$ component") whose presence causes the polymerized material, or a portion thereof to have a higher glass transition temperature, $T_g$, as compared to an otherwise identical material lacking such high $T_g$ component. Preferred monomeric constituents of the high $T_g$ component generally include monomers whose homopolymers have a $T_g$ of at least about 50° C., preferably at least about 60° C., and more preferably at least about 75° C. in the cured state, provided in a combination so that the D component of the copolymer has a minimum $T_g$ as discussed herein.

"Polymerizable crystallizable compound" or "PCC" refers to compounds capable of undergoing polymerization to produce a copolymer wherein at least a portion of the copolymer is capable of undergoing reversible crystallization over a reproducible and well-defined temperature range (e.g. the copolymer exhibits a melting and freezing point as determined, for example, by differential scanning calorimetry). PCC's may include monomers, functional oligomers, functional pre-polymers, macromers or other compounds able to undergo polymerization to form a copolymer. In certain preferred embodiments, polymerizable crystallizable compounds, e.g. crystalline monomer(s) are incorporated into the copolymer by chemical bonding to the copolymer. The term "crystalline monomer" refers to a monomer whose homopolymeric analog is capable of independently and reversibly crystallizing at or above room temperature (e.g., 22° C.). The term "chemical bonding" refers to a covalent bond or other chemical link between the polymerizable crystallizable compound and one or more of the other constituents of the copolymer.

In these embodiments, the resulting toner particles can exhibit improved blocking resistance between printed receptors and reduced offset during fusing. If used, one or more of these crystalline monomers may be incorporated into the S and/or D material, but preferably is incorporated into the D material. Suitable crystalline monomers include alkyl (meth)acrylates where the alkyl chain contains more than 13 carbon atoms (e.g. tetradecyl(meth)acrylate, pentadecyl (meth)acrylate, hexadecyl(meth)acrylate, heptadecyl(meth) acrylate, octadecyl(meth)acrylate, etc). Other suitable crystalline monomers whose homopolymers have melting points above 22° C. include aryl acrylates and methacrylates; high molecular weight alpha olefins; linear or branched long chain alkyl vinyl ethers or vinyl esters; long chain alkyl isocyanates; unsaturated long chain polyesters, polysiloxanes and polysilanes; polymerizable natural waxes with melting points above 22° C., polymerizable synthetic waxes with melting points above 22° C., and other similar type materials known to those skilled in the art. As described herein, incorporation of crystalline monomers in the copolymer provides surprising benefits to the resulting liquid toner particles.

It will be understood by those skilled in the art that blocking resistance can be observed at temperatures above room temperature but below the crystallization temperature of the polymer portion incorporating the crystalline monomers or other polymerizable crystallizable compound. Improved blocking resistance is observed when the crystalline monomer or PCC is a major component of the S material, preferably greater than 45%, more preferably greater than or equal to 75%, most preferably greater than or equal to 90% by weight of the S material incorporated into the copolymer.

Many crystalline monomers tend to be soluble in oleophilic solvents commonly used as liquid carrier material(s) in an organosol. Thus, crystalline monomers are relatively easily incorporated into S material without impacting desired solubility characteristics. However, if too much of such crystalline monomer were to be incorporated into D material, the resultant D material may tend to be too soluble in the organosol. Yet, so long as the amount of soluble, crystalline monomer in the D material is limited, some amount of crystalline monomer may be advantageously incorporated into the D material without unduly impacting the desired insolubility characteristics. Thus, when present in the D material, the crystalline monomer is preferably provided in an amount of up to about 30%, more preferably up to about 20%, most preferably up to about 5% to 10% of the total D material incorporated into the copolymer.

Multifunctional free radically reactive materials may also used to enhance one or more properties of the resultant toner particles, including crosslink density, hardness, tackiness, mar resistance, or the like. Examples of such higher functional, monomers include ethylene glycol di(meth)acrylate, hexanediol di(meth)acrylate, triethylene glycol di(meth) acrylate, tetraethylene glycol di(meth)acrylate, trimethylolpropane tri(meth)acrylate, ethoxylated trimethylolpropane tri(meth)acrylate, glycerol tri(meth)acrylate, pentaerythritol tri(meth)acrylate, pentaerythritol tetra(meth)acrylate, and neopentyl glycol di(meth)acrylate, divinyl benzene, combinations of these, and the like.

Suitable free radically reactive oligomer and/or polymeric materials for use in the present invention include, but are not limited to, (meth)acrylated urethanes (i.e., urethane (meth) acrylates), (meth)acrylated epoxies (i.e., epoxy (meth)acrylates), (meth)acrylated polyesters (i.e., polyester (meth)acrylates), (meth)acrylated (meth)acrylics, (meth)acrylated silicones, (meth)acrylated polyethers (i.e., polyether (meth) acrylates), vinyl (meth)acrylates, and (meth)acrylated oils.

Preferred graft amphipathic copolymers that may be used as a starting formulation for incorporation of polysiloxane moieties to form binder particles of the present invention are described in Qian et al, U.S. Ser. No. 10/612,243, filed on Jun. 30, 2003, entitled ORGANOSOL INCLUDING AMPHIPATHIC COPOLYMERIC BINDER AND USE OF THE ORGANOSOL TO MAKE DRY TONERS FOR ELECTROGRAPHIC APPLICATIONS and Qian et al., U.S. Ser. No. 10/612,535, filed on Jun. 30, 2003, entitled ORGANOSOL INCLUDING AMPHIPATHIC COPOLYMERIC BINDER HAVING CRYSTALLINE MATERIAL, AND USE OF THE ORGANOSOL TO MAKE DRY TONER FOR ELECTROGRAPHIC APPLICATIONS for dry toner compositions; and Qian et al., U.S. Ser. No. 10/612,534, filed on Jun. 30, 2003, entitled ORGANOSOL LIQUID TONER INCLUDING AMPHIPATHIC COPOLYMERIC BINDER HAVING CRYSTALLINE COMPONENT; Qian et al., U.S. Ser. No. 10/612,765, filed on Jun. 30, 2003, entitled ORGANOSOL INCLUDING HIGH Tg AMPHIPATHIC COPOLYMERIC BINDER AND LIQUID TONER FOR ELECTROPHOTOGRAPHIC APPLICATIONS; and Qian et al., U.S. Ser. No. 10/612,533, filed on Jun. 30, 2003, entitled ORGANOSOL INCLUDING AMPHIPATHIC COPOLYMERIC BINDER MADE WITH SOLUBLE HIGH Tg MONOMER AND LIQUID TONERS FOR ELECTROPHOTOGRAPHIC APPLICATIONS for liquid toner compositions, which are hereby incorporated by reference.

Copolymers of the present invention can be prepared by free-radical polymerization methods known in the art, including but not limited to bulk, solution, and dispersion polymerization methods. The resultant copolymers may have a variety of structures including linear, branched, three dimensionally networked, graft-structured, combinations thereof, and the like. A preferred embodiment is a graft copolymer comprising one or more oligomeric and/or polymeric arms attached to an oligomeric or polymeric backbone. In graft copolymer embodiments, the S portion or D portion materials, as the case may be, may be incorporated into the arms and/or the backbone.

Any number of reactions known to those skilled in the art may be used to prepare a free radically polymerized copolymer having a graft structure. Common grafting methods include random grafting of polyfunctional free radicals; copolymerization of monomers with macromonomers; ring-opening polymerizations of cyclic ethers, esters, amides or acetals; epoxidations; reactions of hydroxyl or amino chain transfer agents with terminally-unsaturated end groups; esterification reactions (i.e., glycidyl methacrylate undergoes tertiary-amine catalyzed esterification with methacrylic acid); and condensation polymerization.

Representative methods of forming graft copolymers are described in U.S. Pat. Nos. 6,255,363; 6,136,490; and 5,384,226; and Japanese Published Patent Document No. 05-119529, incorporated herein by reference. Representative examples of grafting methods are also described in sections 3.7 and 3.8 of Dispersion Polymerization in Organic Media, K. E. J. Barrett, ed., (John Wiley; New York, 1975) pp. 79–106, also incorporated herein by reference.

Representative examples of grafting methods also may use an anchoring group. The function of the anchoring group is to provide a covalently bonded link between the core part of the copolymer (the D material) and the soluble shell component (the S material). Suitable monomers containing anchoring groups include: adducts of alkenylazlactone comonomers with an unsaturated nucleophile containing hydroxy, amino, or mercaptan groups, such as 2-hydroxyethylmethacrylate, 3-hydroxypropylmethacrylate, 2-hydroxyethylacrylate, pentaerythritol triacrylate, 4-hydroxybutylvinylether, 9-octadecen-1-ol, cinnamyl alcohol, allyl mercaptan, methallylamine; and azlactones, such as 2-alkenyl-4,4-dialkylazlactone.

The preferred methodology described above accomplishes grafting via attaching an ethylenically-unsaturated isocyanate (e.g. dimethyl-m-isopropenyl benzylisocyanate, TMI, available from CYTEC Industries, West Paterson, N.J.; or isocyanatoethyl methacrylate, IEM) to hydroxyl groups in order to provide free radically reactive anchoring groups.

A preferred method of forming a graft copolymer of the present invention involves three reaction steps that are carried out in a suitable substantially nonaqueous liquid carrier in which resultant S material is soluble while D material is dispersed or insoluble.

In a first preferred step, a hydroxyl functional, free radically polymerized oligomer or polymer is formed from one or more monomers, wherein at least one of the monomers has pendant hydroxyl functionality. Preferably, the hydroxyl functional monomer constitutes about 1 to about 30, preferably about 2 to about 10 percent, most preferably 3 to about 5 percent by weight of the monomers used to form the oligomer or polymer of this first step. This first step is preferably carried out via solution polymerization in a substantially nonaqueous solvent in which the monomers and the resultant polymer are soluble. For instance, using the Hildebrand solubility data in Table 1, monomers such as octadecyl methacrylate, octadecyl acrylate, lauryl acrylate, and lauryl methacrylate are suitable for this first reaction step when using an oleophilic solvent such as heptane or the like.

In a second reaction step, all or a portion of the hydroxyl groups of the soluble polymer are catalytically reacted with an ethylenically unsaturated aliphatic isocyanate (e.g. meta-isopropenyldimethylbenzyl isocyanate commonly known as TMI or isocyanatoethyl methacrylate, commonly known as IEM) to form pendant free radically polymerizable functionality which is attached to the oligomer or polymer via a polyurethane linkage. This reaction can be carried out in the same solvent, and hence the same reaction vessel, as the first step. The resultant double-bond functionalized polymer generally remains soluble in the reaction solvent and constitutes the S portion material of the resultant copolymer, which ultimately will constitute at least a portion of the solvatable portion of the resultant triboelectrically charged particles.

The resultant free radically reactive functionality provides grafting sites for attaching D material and optionally additional S material to the polymer. In a third step, these grafting site(s) are used to covalently graft such material to the polymer via reaction with one or more free radically reactive monomers, oligomers, and or polymers that are initially soluble in the solvent, but then become insoluble as the molecular weight of the graft copolymer. For instance, using the Hildebrand solubility parameters in Table 1, monomers such as e.g. methyl (meth)acrylate, ethyl (meth)acrylate, t-butyl methacrylate and styrene are suitable for this third reaction step when using an oleophilic solvent such as heptane or the like.

The product of the third reaction step is generally an organosol comprising the resultant copolymer dispersed in the reaction solvent, which constitutes a substantially nonaqueous liquid carrier for the organosol. At this stage, it is believed that the copolymer tends to exist in the liquid carrier as discrete, monodisperse particles having dispersed (e.g., substantially insoluble, phase separated) portion(s) and solvated (e.g., substantially soluble) portion(s). As such, the solvated portion(s) help to sterically-stabilize the dispersion of the particles in the liquid carrier. It can be appreciated that the copolymer is thus advantageously formed in the liquid carrier in situ.

One fabrication technique to prepare toner compositions of the present invention involves synthesizing an amphipathic copolymeric binder dispersed in a liquid carrier to form an organosol, then mixing the formed organosol with other ingredients to form a liquid toner composition. Typically, organosols are synthesized by nonaqueous dispersion polymerization of polymerizable compounds (e.g. monomers) to form copolymeric binder particles that are dispersed in a low dielectric hydrocarbon solvent (carrier liquid). These dispersed copolymer particles are sterically-stabilized with respect to aggregation by chemical bonding of a steric stabilizer (e.g. graft stabilizer), solvated by the carrier liquid, to the dispersed core particles as they are formed in the polymerization. Details of the mechanism of such steric stabilization are described in Napper, D. H., "Polymeric Stabilization of Colloidal Dispersions," Academic Press, New York, N.Y., 1983. Procedures for synthesizing self-stable organosols are described in "Dispersion Polymerization in Organic Media," K. E. J. Barrett, ed., John Wiley: New York, N.Y., 1975.

Liquid toner compositions have been manufactured using dispersion polymerization in low polarity, low dielectric constant carrier solvents for use in making relatively low glass transition temperature ($T_g \leqq 30°$ C.) film-forming liquid toners that undergo rapid self-fixing in the electrophotographic imaging process. See, e.g., U.S. Pat. Nos. 5,886,067 and 6,103,781. Organosols have also been prepared for use in making intermediate glass transition temperature ($T_g$ between 30–55° C.) liquid electrostatic toners for use in electrostatic stylus printers. See e.g. U.S. Pat. No. 6,255,363 B1. A representative non-aqueous dispersion polymerization method for forming an organosol is a free radical polymerization carried out when one or more ethylenically-unsaturated monomers, soluble in a hydrocarbon medium, are polymerized in the presence of a preformed, polymerizable solution polymer (e.g. a graft stabilizer or "living" polymer). See U.S. Pat. No. 6,255,363.

Once the organosol has been formed, one or more additives can be incorporated, as desired. For example, one or more visual enhancement additives and/or charge control agents can be incorporated. The composition can then be subjected to one or more mixing processes, such as homogenization, microfluidization, ball-milling, attritor milling, high energy bead (sand) milling, basket milling or other techniques known in the art to reduce particle size in a dispersion. The mixing process acts to break down aggregated visual enhancement additive particles, when present, into primary particles (having a diameter in the range of 0.05 to 1.0 microns) and may also partially shred the dispersed copolymeric binder into fragments that can associate with the surface of the visual enhancement additive. According to this embodiment, the dispersed copolymer or fragments derived from the copolymer then associate with the visual enhancement additive, for example, by adsorbing to or adhering to the surface of the visual enhancement additive, thereby forming toner particles. The result is a sterically-stabilized, nonaqueous dispersion of toner particles having a size in the range of about 0.1 to 2.0 microns, with typical toner particle diameters in the range 0.1 to 0.5 microns. In some embodiments, one or more charge control agents can be added after mixing, if desired.

Before further processing, the copolymer particles may remain in the reaction solvent. Alternatively, the particles may be transferred in any suitable way into fresh solvent that is the same or different so long as the copolymer has solvated and dispersed phases in the fresh solvent. In either case, the resulting organosol is then converted into toner particles by mixing the organosol with at least one visual enhancement additive. Optionally, one or more other desired ingredients also can be mixed into the organosol before and/or after combination with the visual enhancement particles. During such combination, it is believed that ingredients comprising the visual enhancement additive and the copolymer will tend to self-assemble into composite particles having a structure wherein the dispersed phase portions generally tend to associate with the visual enhancement additive particles (for example, by physically and/or chemically interacting with the surface of the particles), while the solvated phase portions help promote dispersion in the carrier.

The visual enhancement additive(s) generally may include any one or more fluid and/or particulate materials that provide a desired visual effect when toner particles incorporating such materials are printed onto a receptor. Examples include one or more colorants, fluorescent materials, pearlescent materials, iridescent materials, metallic materials, flip-flop pigments, silica, polymeric beads, reflective and non-reflective glass beads, mica, combinations of these, and the like. The amount of visual enhancement additive coated on binder particles may vary over a wide range. In representative embodiments, a suitable weight ratio of copolymer to visual enhancement additive is from 1/1 to 20/1, preferably from 2/1 to 10/1 and most preferably from 4/1 to 8/1.

Useful colorants are well known in the art and include materials listed in the Colour Index, as published by the Society of Dyers and Colourists (Bradford, England), including dyes, stains, and pigments. Preferred colorants are pigments which may be combined with ingredients comprising the binder polymer to form dry toner particles with structure as described herein, are at least nominally insoluble in and nonreactive with the carrier liquid, and are useful and effective in making visible the latent electrostatic image. It is understood that the visual enhancement additive(s) may also interact with each other physically and/or chemically, forming aggregations and/or agglomerates of visual enhancement additives that also interact with the binder polymer. Examples of suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105 and 111), isoindoline yellow (C.I. Pigment Yellow 138), azo red (C.I. Pigment Red 3, 17, 22, 23, 38, 48:1, 48:2, 52:1, and 52:179), quinacridone magenta (C.I. Pigment Red 122, 202 and 209), laked rhodamine magenta (C.I. Pigment Red 81:1, 81:2, 81:3, and 81:4), and black pigments such as finely divided carbon (Cabot Monarch 120, Cabot Regal 300R, Cabot Regal 350R, Vulcan X72, and Aztech EK 8200), and the like.

In addition to the visual enhancement additive, other additives optionally can be formulated into the liquid toner composition.

Charge directors, may be used in any liquid toner process, and particularly may be used for electrostatic transfer of toner particles or transfer assist materials. The charge director typically provides the desired uniform charge polarity of the toner particles. In other words, the charge director acts to impart an electrical charge of selected polarity onto the toner particles as dispersed in the carrier liquid. Preferably, the charge director is coated on the outside of the binder particle. Alternatively or additionally, the charge director may be incorporated into the toner particles using a wide variety of methods, such as copolymerizing a suitable monomer with the other monomers to form a copolymer, chemically reacting the charge director with the toner particle, chemically or physically adsorbing the charge director onto the toner particle, or chelating the charge director to a functional group incorporated into the toner particle.

The preferred amount of charge director when using an organosol binder particle further depends on the composition of the S portion of the graft copolymer, the composition of the organosol, the molecular weight of the organosol, the particle size of the organosol, the core/shell ratio of the graft copolymer, the pigment used in making the toner, and the ratio of organosol to pigment. In addition, preferred amounts of charge director will also depend upon the nature of the electrophotographic imaging process, particularly the design of the developing hardware and photoreceptive element. It is understood, however, that the level of charge director may be adjusted based on a variety of parameters to achieve the desired results for a particular application.

Any number of charge directors such as those described in the art may be used in the liquid toners or transfer assist materials of the present invention in order to impart a negative electrical charge onto the toner particles. For example, the charge director may be lecithin, oil-soluble petroleum sulfonates (such as neutral Calcium Petronate™, neutral Barium Petronate™, and basic Barium Petronate™, manufactured by Sonneborn Division of Witco Chemical Corp., New York, N.Y.), polybutylene succinimides (such as OLOA™ 1200 sold by Chevron Corp., and Amoco 575), and glyceride salts (such as sodium salts of phosphated mono- and diglycerides with unsaturated and saturated acid substituents as disclosed in U.S. Pat. No. 4,886,726 to Chan et al). A preferred type of glyceride charge director is the alkali metal salt (e.g., Na) of a phosphoglyceride. A preferred example of such a charge director is Emphos™ D70-30C, Witco Chemical Corp., New York, N.Y., which is a sodium salt of phosphated mono- and diglycerides.

Any number of charge directors such as those described in the art may be used in the liquid toners or transfer assist materials of the present invention in order to impart a positive electrical charge onto the toner particles. For example, the charge director may be introduced in the form of metal salts consisting of polyvalent metal ions and organic anions as the counterion. Suitable metal ions include Ba(II), Ca(II), Mn(II), Zn(II), Zr(IV), Cu(II), Al(III), Cr(III), Fe(II), Fe(III), Sb(III), Bi(III) Co(II), La(III), Pb(II), Mg(II), Mo(III), Ni(II), Ag(I), Sr(II), Sn(IV), V(V), Y(III) and Ti(IV). Suitable organic anions include carboxylates or sulfonates derived from aliphatic or aromatic carboxylic or sulfonic acids, preferably aliphatic fatty acids such as stearic acid, behenic acid, neodecanoic acid, diisopropylsalicylic acid, octanoic acid, abietic acid, naphthenic acid, octanoic acid, lauric acid, tallic acid, and the like. Preferred positive charge directors are the metallic carboxylates (soaps), such as those described in U.S. Pat. No. 3,411,936. A particularly preferred positive charge director is zirconium tetraoctoate (available as Zirconium HEX-CEM from OMG Chemical Company, Cleveland, Ohio).

The conductivity of a liquid toner composition can be used to describe the effectiveness of the toner in developing electrophotographic images. A range of values from $1\times10^{-11}$ mho/cm to $3\times10^{-10}$ mho/cm is considered advantageous to those of skill in the art. High conductivities generally indicate inefficient association of the charges on the toner particles and is seen in the low relationship between current density and toner deposited during development. Low conductivities indicate little or no charging of the toner particles and lead to very low development rates. The use of charge control agents matched to adsorption sites on the toner particles is a common practice to ensure sufficient charge associates with each toner particle.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, and the like.

The particle size of the resultant charged toner particles can impact the imaging, fusing, resolution, and transfer characteristics of the toner composition incorporating such particles. Preferably, the volume mean particle diameter (determined with laser diffraction) of the particles is in the range of about 0.05 to about 50.0 microns, more preferably in the range of about 3 to about 10 microns, most preferably in the range of about 1.5 to about 5 microns.

In electrophotographic processes, the toner composition preferably is provided at a solids content of about 1–30%. In electrostatic processes, the toner composition preferably is provided at a solids content of 3–15%.

The substrate for receiving the image from the photoreceptive element can be any commonly used receptor material, such as paper, coated paper, polymeric films and primed or coated polymeric films. Polymeric films include polyesters and coated polyesters, polyolefins such as polyethylene or polypropylene, plasticized and compounded polyvinyl chloride (PVC), acrylics, polyurethanes, polyethylene/acrylic acid copolymer, and polyvinyl butyrals. The polymer film may be coated or primed, e.g. to promote toner adhesion.

In one embodiment of the present invention, the toner composition is provided with a visual enhancement additive to provide, such as a colorant, for forming visually apparent images. The toner compositions as provided herein afford unique release and adhesion characteristics that may advantageously be used for process advantages, such as performance under desired process conditions, and/or final product advantages, such as affinity to certain substrates, durability and the like.

The toner composition of the present invention may optionally be formulated without a visual enhancement additive to exhibit release properties under certain process conditions, so that a transfer assist layer formed by the toner composition does not adhere to a photoreceptor or to an intermediate transfer member (such as a belt, roller, drum or the like). The presence of a transfer assist layer in the toned image facilitates the transfer of that image from one surface to another in an image transfer process. The transfer assist layer may be applied to a surface that itself does not have release properties, or alternatively may be applied to a surface in order to augment the release properties of that surface.

In one embodiment of the present invention, a transfer assist layer formed by a toner composition as provided herein may be applied to a photoreceptor, either as a flood coat, or in registration with an image to be formed on the photoreceptor. After formation of the transfer assist layer, one or more colored toners is applied over the transfer assist layer to form the desired image. The image may be formed in a multi-pass imaging process or a tandem imaging process. The thus formed image may then be transferred directly to an intended final substrate, with separation of the toned image from the photoreceptor assisted by the presence of the transfer assist layer. The transfer assist layer may in one embodiment substantially release from the photoreceptor, leaving essentially no residue behind on the photoreceptor. The resulting image in place on the substrate comprises a toned image having an overcoat of a transfer assist layer on top of the image. Alternatively, the transfer assist layer may fracture or otherwise separate, thereby acting as a sacrificial layer and leaving substantial residue on the photoreceptor. The remaining residue may readily be removed from the photoreceptor by conventional processes without adverse effect on the integrity of the image that is transferred. The resulting image in place on the substrate comprises a toned image optionally having residues of the transfer assist layer on top of the image.

In an alternative embodiment, one or more colored toners are applied to a photoreceptor to form the desired image. The image may be formed in a multi-pass imaging process or a tandem imaging process. A transfer assist layer formed by a toner composition as provided herein may be applied, either as a flood coat or in registration, over the image formed on the photoreceptor. After formation of the transfer assist layer, the thus formed image may then be transferred to an intermediate transfer material ("ITM"), thereby placing the transfer assist layer in contact with the ITM. The image may then be transferred from the ITM to an intended final substrate, with separation of the toned image from the ITM assisted by the presence of the transfer assist layer. The transfer assist layer may in one embodiment substantially release from the ITM, leaving essentially no residue behind on the ITM. The resulting image in place on the substrate comprises a toned image having an overcoat of a transfer assist layer on top of the image. Alternatively, the transfer assist layer may fracture or otherwise separate, thereby acting as a sacrificial layer and leaving substantial residue on the ITM. The remaining residue may readily be removed from the ITM by conventional processes without adverse effect on the integrity of the image that is transferred. The resulting image in place on the substrate comprises a toned image optionally having residues of the transfer assist layer on top of the image.

In a preferred aspect of the above embodiments, the transfer assist layer is formulated to provide a protective and/or image enhancing layer over the top of a toned image. Thus, an overcoat may be provided that is readily compatible with the toned image, and the may enhance the durability of the image and protect the image from environmental assaults. Furthermore, the image may be overcoated in a convenient manner without use of additional equipment or separate processing steps. When the transfer assist composition is formulated for use as a protective overcoat, the composition generally is provided without color. Preferably, the resulting protective overcoat is substantially clear in appearance. Alternatively, the composition may be colored, particularly with a light tint, for aesthetic purposes.

In one embodiment of the present invention, the transfer assist composition is formulated to form a layer that has a tacky surface, thereby encouraging a bond between the pigmented toner particles and the final image receptor. In fact, if the glass transition temperature ($T_g$) is formulated to be relatively low (making it tacky), it is possible that a relatively low to moderate fusing temperature can enable the pigment particles to melt and flow more easily into a porous final receptor, thereby creating a strong bond between the toner and the final receptor. Preferably, the copolymer of this embodiment has a $T_g$ that is lower than about 35° C. and could be below about −10° C. In addition, the transfer assist layer can include enhancement properties that facilitate fusing of the image at lower temperatures than without such a transfer assist layer, which can provide benefits from a manufacturing and safety standpoint. Additionally, this embodiment may have benefits that are not necessarily related to improving transfer efficiency, such as providing a basecoat (that might promote, for example, adhesion) between the toned image and the final substrate.

In one embodiment of the present invention, a transfer assist layer formed by a toner composition as provided herein may be applied to a photoreceptor, either as a flood coat, or in registration with an image to be formed on the photoreceptor. After formation of the transfer assist layer, one or more colored toners is applied over the transfer assist layer to form the desired image. The image may be formed in a multi-pass imaging process or a tandem imaging process. The thus formed image may then be transferred to an ITM, with separation of the toned image from the photoreceptor assisted by the presence of the transfer assist layer. The transfer assist layer may in one embodiment substantially release from the photoreceptor, leaving essentially no residue behind on the photoreceptor. Alternatively, the transfer assist layer may fracture or otherwise separate, thereby acting as a sacrificial layer and leaving substantial residue on the photoreceptor. The remaining residue may readily be removed from the photoreceptor by conventional processes without adverse effect on the integrity of the image that is transferred. This transfer places the toned image in direct contact with the ITM, with the transfer assist layer on top of the image. The image may then be transferred from the ITM to an intended final substrate. The resulting image in place on the substrate comprises a toned image having a basecoat of a transfer assist layer.

In an alternative embodiment, one or more colored toners are applied to a photoreceptor to form the desired image. The image may be formed in a multi-pass imaging process or a tandem imaging process. A transfer assist layer formed by a toner composition as provided herein may be applied, either as a flood coat or in registration, over the image formed on the photoreceptor. After formation of the transfer assist layer, the thus formed image may then be transferred directly to an intended final substrate. The resulting image in place on the substrate comprises a toned image having a basecoat of a transfer assist layer.

When the toner composition is formulated for use as a basecoat to be in direct contact with the ultimate substrate, the composition may be provided with or without color. Preferably, the composition is provided without color so as to be readily used as a universal base that is substantially clear for use with any colored toner. The thus provided basecoat preferably does not interfere with the aesthetics of the colored toner that may be used for the desired final image.

These and other aspects of the present invention are demonstrated in the illustrative examples that follow.

EXAMPLES

Test Methods and Apparatus

Percent Solids

In the following toner composition examples, percent solids of the graft stabilizer solutions and the organosol and liquid toner dispersions were determined thermo-gravimetrically by drying in an aluminum weighing pan an originally-weighed sample at 160° C. for two hours for graft stabilizers or organosols and for three hours for liquid toners, weighing the dried sample, and calculating the percentage ratio of the dried sample weight to the original sample weight, after accounting for the weight of the aluminum weighing pan. Approximately two grams of sample were used in each determination of percent solids using this thermo-gravimetric method.

Particle Size

Polymer and toner particle size distributions were determined using a Horiba LA-900 laser diffraction particle size analyzer (Horiba Instruments, Inc., Irvine, Calif.). Samples are diluted approximately 1/500 by volume and sonicated for one minute at 150 watts and 20 kHz prior to measurement. Particle size was expressed as both a number mean diameter ($D_n$) and a volume mean diameter ($D_v$) and in order to provide an indication of both the fundamental (primary) particle size and the presence of aggregates or agglomerates.

Glass Transition Temperature

Thermal transition data for synthesized TM was collected using a TA Instruments Model 2929 Differential Scanning Calorimeter (New Castle, Del.) equipped with a DSC refrigerated cooling system (−70° C. minimum temperature limit), and dry helium and nitrogen exchange gases. The calorimeter ran on a Thermal Analyst 2100 workstation with version 8.10B software. An empty aluminium pan was used as the reference. The samples were prepared by placing 6.0 to 12.0 mg of the experimental material into an aluminum sample pan and crimping the upper lid to produce a hermetically sealed sample for DSC testing. The results were normalized on a per mass basis. Each sample was evaluated using 10° C./min heating and cooling rates with a 5–10 min isothermal bath at the end of each heating or cooling ramp. The experimental materials were heated five times: the first heat ramp removes the previous thermal history of the sample and replaces it with the 10° C./min cooling treatment and subsequent heat ramps are used to obtain a stable glass transition temperature value—values are reported from either the third or fourth heat ramp.

Conductivity

The liquid toner conductivity (bulk conductivity, $k_b$) was determined at approximately 18 Hz using a Scientifica Model 627 conductivity meter (Scientifica Instruments, Inc., Princeton, N.J.). In addition, the free (liquid dispersant) phase conductivity ($k_f$) in the absence of toner particles was also determined. Toner particles were removed from the liquid medium by centrifugation at 5° C. for 1–2 hours at 6,000 rpm (6,110 relative centrifugal force) in a Jouan MR1822 centrifuge (Winchester, Va.). The supernatant liquid was then carefully decanted, and the conductivity of this liquid was measured using a Scientifica Model 627 conductance meter. The percentage of free phase conductivity relative to the bulk toner conductivity was then determined as 100% ($k_f/k_b$).

Mobility

Toner particle electrophoretic mobility (dynamic mobility) was measured using a Matec MBS-8000 Electrokinetic Sonic Amplitude Analyzer (Matec Applied Sciences, Inc., Hopkinton, MA). Unlike electrokinetic measurements based upon microelectro-phoresis, the MBS-8000 instrument has the advantage of requiring no dilution of the toner sample in order to obtain the mobility value. Thus, it was possible to measure toner particle dynamic mobility at solids concentrations actually preferred in printing. The MBS-8000 measures the response of charged particles to high frequency (1.2 MHz) alternating (AC) electric fields. In a high frequency AC electric field, the relative motion between charged toner particles and the surrounding dispersion medium (including counter-ions) generates an ultrasonic wave at the same frequency of the applied electric field. The amplitude of this ultrasonic wave at 1.2 MHz can be measured using a piezoelectric quartz transducer; this electrokinetic sonic amplitude (ESA) is directly proportional to the low field AC electrophoretic mobility of the particles. The particle zeta potential can then be computed by the instrument from the measured dynamic mobility and the known toner particle size, liquid dispersant viscosity, and liquid dielectric constant.

Q/M

The charge per mass measurement (Q/M) was measured using an apparatus that consists of a conductive metal plate, a glass plate coated with Indium Tin Oxide (ITO), a high voltage power supply, an electrometer, and a personal computer (PC) for data acquisition. A 1% solution of ink was placed between the conductive plate and the ITO coated glass plate. An electrical potential of known polarity and magnitude was applied between the ITO coated glass plate and the metal plate, generating a current flow between the plates and through wires connected to the high voltage power supply. The electrical current was measured 100 times a second for 20 seconds and recorded using the PC. The applied potential causes the charged toner particles to migrate towards the plate (electrode) having opposite polarity to that of the charged toner particles. By controlling the polarity of the voltage applied to the ITO coated glass plate, the toner particles may be made to migrate to that plate.

The ITO coated glass plate was removed from the apparatus and placed in an oven for approximately 30 minutes at 50° C. to dry the plated ink completely. After drying, the ITO coated glass plate containing the dried ink film was weighed. The ink was then removed from the ITO coated glass plate using a cloth wipe impregnated with Norpar™ 12, and the clean ITO glass plate was weighed again. The difference in mass between the dry ink coated glass plate and the clean glass plate is taken as the mass of ink particles (m) deposited during the 20 second plating time. The electrical current values were used to obtain the total charge carried by the toner particles (Q) over the 20 seconds of plating time by integrating the area under a plot of current vs. time using a curve-fitting program (e.g. TableCurve 2D from Systat Software Inc.). The charge per mass (Q/m) was then determined by dividing the total charge carried by the toner particles by the dry plated ink mass.

MATERIALS

The following abbreviations are used in the examples:

EA: Ethyl acrylate (available from Aldrich Chemical Co., Milwaukee, Wis.)

EHMA: 2-Ethylhexyl methacrylate (available from Aldrich Chemical Co., Milwaukee, Wis.)

EMA: Ethyl methacrylate (available from Aldrich Chemical Co., Milwaukee, Wis.)

HEMA: 2-Hydroxyethyl methacrylate (available from Aldrich Chemical Co., Milwaukee, Wis.)

MAA: Methacrylate acid (available from Aldrich Chemical Co., Milwaukee, Wis.)

MMA: Methyl methacrylate (Aldrich Chemical Co., Milwaukee, Wis.)

PDMSMA: Polydimethyl siloxane mono-methacrylate having a molecular weight of Mn=10,000 (available from Aldrich Chemical Co., Milwaukee, Wis.)

TCHMA: Trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

AIBN: Azobisisobutyronitrile (an initiator available as VAZO-64 from DuPont Chemical Co., Wilmington, Del.)

V-601: Dimethyl 2,2'-azobisisobutyrate (an initiator available as V-601 from WAKO Chemicals U.S.A., Richmond, Va.)

DBTDL: Dibutyl tin dilaurate (a catalyst available from Aldrich Chemical Co., Milwaukee, Wis.)

Zirconium HEX-CEM: (metal soap, zirconium tetraoctoate, available from OMG Chemical Company, Cleveland, Ohio)

NOMENCLATURE

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) designated TCHMA/HEMA-TMI (97/3-4.7) is made by copolymerizing, on a relative basis, 97 parts by weight TCHMA and 3 parts by weight HEMA, and this hydroxy functional polymer was reacted with 4.7 parts by weight of TMI.

Similarly, a graft copolymer organosol designated TCHMA/HEMA-TMI//EMA (97/3-4.7//100) is made by copolymerizing the designated graft stabilizer (TCHMA/HEMA-TMI (97/3-4.7)) (S portion or shell) with the designated core monomer EMA (D portion or core, 100% EMA) at a specified ratio of D/S (i.e. the core/shell ratio) determined by the relative weights reported in the examples.

Preparations of Copolymer Graft Stabilizer

Example 1 (Comparative)

A 5000 ml 3-neck round flask equipped with a condenser, a thermocouple connected to a digital temperature controller, a nitrogen inlet tube connected to a source of dry nitrogen and a magnetic stirrer, was charged with a mixture of 2561 g of Norpar™ 12, 849 g of EHMA, 26.7 g of 98% HEMA and 8.31 g of AIBN. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/min. The mixture was heated to 70° C. for 16 hours. The conversion was quantitative.

The mixture was heated to 90° C. and held at that temperature for 1 hour to destroy any residual AIBN, and then was cooled back to 70° C. The nitrogen inlet tube was then removed, and 13.6 g of 95% DBTDL were added to the mixture, followed by 41.1 g of TMI. The TMI was added drop wise over the course of approximately 5 minutes while stirring the reaction mixture. The nitrogen inlet tube was replaced, the hollow glass stopper in the condenser was removed, and the reaction flask was purged with dry nitrogen for 30 minutes at a flow rate of approximately 2 liters/minute. The hollow glass stopper was reinserted into the open end of the condenser and the nitrogen flow rate was reduced to approximately 0.5 liters/min. The mixture was allowed to react at 70° C. for 6 hours, at which time the conversion was quantitative.

The mixture was then cooled to room temperature. The cooled mixture was a viscous, transparent liquid containing no visible insoluble mater. The percent of solids of the liquid mixture was determined to be 26.0% using the Halogen Drying Method described above. Subsequent determination of molecular weight was made using the GPC method described above; the copolymer had a $M_w$ of 201,500 Da and $M_w/M_n$ of 3.3 based on two independent measurements. The product is a copolymer of EHMA and HEMA containing random side chains of TMI and is designed herein as EHMA/HEMA-TMI (97/3-4.7% w/w) and suitable for making an organosol.

Preparations of Organosol

Example 2 (Comparative)

This is an example using the graft stabilizer in Example 1 to prepare an organosol without any functional groups. A 5000 ml 3-neck round flask equipped with a condenser, a thermocouple connected to a digital temperature controller, a nitrogen inlet tube connected to a source of dry nitrogen and a magnetic stirrer, was charged with a mixture of 2568 g of Norpar™ 12, 468.05 g of EA, 154.17 g of MMA, 299.15 g of the graft stabilizer mixture from Example 1 @ 26.0% polymer solids, and 10.50 g of V-601 were combined. The mixture was heated to 70° C. for 16 hours. The conversion was quantitative. The mixture then was cooled to room temperature. Approximately 500 g of n-heptane were added to the cooled organosol, and the resulting mixture was stripped of residual monomer using a rotary evaporator equipped with a dry ice/acetone condenser and operating at a temperature of 90° C. and a vacuum of approximately 15 mm Hg. The stripped organosol was cooled to room temperature, yielding an opaque white dispersion. This organosol is designed EHMA/HEMA-TMI//EA/MMA (97/3-4.7/175/25% w/w). The percent solids of the organosol dispersion after stripping was determined as 21.8% using Halogen Drying Method described above. Subsequent determination of average particles size was made using the light scattering method described above; the organosol had a volume average diameter of 18.1 μm. The organosol particles had a $T_g$ of 6.6° C. measured using the DSC method described above.

Example 3

PDMSMA Organosol

A 5 liter 3-necked round bottom flask equipped with a condenser, a thermocouple connected to a digital temperature controller, a nitrogen inlet tube connected to a source of dry nitrogen and an overhead stirrer, was charged with a mixture of 3074 g of Norpar™ 12, 84 g of PDMSMA (commercially available from Aldrich Chemical, Milwaukee, Wis. and used in this Example as the S portion of the amphipathic copolymer), 84 g of MMA (commercially available from Aldrich Chemical, Milwaukee, Wis.), 252 g of EA (commercially available from Aldrich Chemical, Milwaukee, Wis.), and 6.3 g of AIBN. While the mixture was stirred, the reaction flask was purged with dry nitrogen for 30 minutes at a flow rate of approximately 2 liters/minute. A hollow glass stopper was then inserted into the open end of the condenser and the nitrogen flow rate was reduced to approximately 0.5 liter/min. The mixture was heated to 70° C. with stirring, and the mixture was allowed to polymerize at 70° C. for 16 hours. The conversion was quantitative.

Approximately 350 g of n-heptane were added to the cooled organosol, and the resulting mixture was stripped of residual monomer using a rotary evaporator equipped with a dry ice/acetone condenser and operating at a temperature of 90° C. and a vacuum of approximately 15 mm Hg. The stripped organosol was cooled to room temperature, yielding an opaque white dispersion. This organosol is designated PDMSMA//EA/MMA.

The percent of solids of this non-gel organosol dispersion was determined to be 14.7% after stripping. Subsequent determination of average particle size was made using the Horiba 920 laser light scattering particle size analyzer, which gave a volume average particle size of 0.2105 microns.

TABLE 1

Organosol Compositions

| Example Numbers | Organosol Compositions (% w/w) | Core/ Shell ratio | SILICONE ADDITIVE |
|---|---|---|---|
| 2 | EHMA/HEMA-TMI//EA/MMA (97/3–4.7//75/25) | 8 | None |
| 3 | PDMSMA//EA/MMA (100//75/25) | 4 | PDMSMA |

Preparation of Liquid Toner

Example 4 (Comparative)

This is an example of preparing a black liquid toner at an organosol pigment ratio of 6 using the organosol prepared at core/shell of 8 in Example 2.142 g of the organosol @ 21.8% (w/w) solids in Norpar™ 12 were combined with 151 g of Norpar™ 12, 5 g of Black pigment (Aztech EK8200, Mcgruder Color Company, Tucson, Ariz.) and 1.81 g of 5.67% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Ltd., Tokyo, Japan) charged with 390 g of 1.3 mm diameter Potters glass beads (potter Industries, Inc., Parsippany, N.J.). The mill was operated at 2,000 RPM for 1.5 hours without cooling water circulating through the cooling jacket of the milling chamber.

A 12% (w/w) solids toner concentrate exhibited the following properties as determined using the test methods described above:

Volume Mean Particle Size: 1.18 micron

Q/M: 397 μC/g

Bulk Conductivity: 1297 picoMhos/cm

Percent Free Phase Conductivity: 2.47%

Dynamic Mobility: 1.17E-10 ($m^2$/Vsec)

Example 5

This is an example of preparing a black liquid toner at an organosol pigment ratio of 6 using the organosol prepared at a core/shell ratio of 4 in example 3.210 g of the organosol in example 1 @14.7% (w/w) solids in Norpar™ 12 with 83 g of Norpar™ 12, 5 g of Black pigment (Aztech EK8200, Mcgruder Color Company, Tucson, Ariz.) and 2.27 g of 5.67% Zirconium HEX-CEM solution (OMG Chemical Company, Cleveland, Ohio) in an 8 ounce glass jar. This mixture was then milled in a 0.5 liter vertical bead mill (Model 6TSG-1/4, Amex Co., Led., Tokyo, Japan) charged with 390 g of 1.3 mm diameter Potters glass beads (Potters Industries, Inc., Parsippany, N.J.). The mill was operated at 2,000 RPM for 12 minutes without cooling water circulating through the cooling jacket of the milling chamber.

A 12% (w/w) solids toner concentrate exhibited the following properties as determined using the test methods described above:

Volume Mean Particle Size: 2.24 micron

Q/M: 1830 μC/g

Bulk Conductivity: 2230 picoMhos/cm

Percent Free Phase Conductivity: 30.19%

Dynamic Mobility: 4.83E-12 ($m^2$/Vsec)

All patents, patent documents, and publications cited herein are incorporated by reference as if individually incorporated. Unless otherwise indicated, all parts and percentages are by weight and all molecular weights are weight average molecular weights. The foregoing detailed description has been given for clarity of understanding only. No unnecessary limitations are to be understood therefrom. The invention is not limited to the exact details shown and described, for variations obvious to one skilled in the art will be included within the invention defined by the claims.

What is claimed is:

1. A liquid electrophotographic toner composition comprising:

a) a liquid carrier having a Kauri-butanol number less than 30 mL; and b) a plurality of toner particles dispersed in the liquid carrier, wherein the toner particles comprise polymeric binder comprising at least one amphipathic copolymer comprising one or more S material portions and one or more D material portions and a visual enhancement additive, wherein the amphipathic copolymer comprises a polysiloxane moiety having molecular weight of at least about 500 Daltons.

2. The liquid electrophotographic toner composition according to claim 1, wherein the polysiloxane moiety comprises from about 3 to about 35% by weight of the solids portion of the toner composition.

3. The liquid electrophotographic toner composition according to claim 1, wherein the polysiloxane moiety comprises from about 10 to about 30% by weight of the solids portion of the toner composition.

4. The liquid electrophotographic toner composition according to claim 1, wherein the polysiloxane moiety comprises from about 15 to about 25% by weight of the solids portion of the toner composition.

5. The liquid electrophotographic toner composition according to claim 1, wherein the polysiloxane moiety has a molecular weight of from about 10,000 to about 1,000,000 Daltons.

6. The liquid electrophotographic toner composition according to claim 1, wherein the polysiloxane moiety has a molecular weight of from about 30,000 to about 500,000 Daltons.

7. The liquid electrophotographic toner composition according to claim 1, wherein the polysiloxane moiety has a structure $$—Si(R)_{3-m}Z_m$$

where R is hydrogen, lower alkyl, aryl, or alkoxy;

m is an integer of from 1 to 3;

and Z is a monovalent siloxane polymeric moiety having a number average molecular weight above about 500 and is essentially unreactive under copolymerization conditions.

8. The liquid electrophotographic toner composition according to claim 1, wherein the polysiloxane moiety is derived from an ethylenically unsaturated organosiloxane chain.

9. The liquid electrophotographic toner composition according to claim 1, wherein the polysiloxane moiety is grafted to a (meth)acrylate copolymer.

10. The liquid electrophotographic toner composition according to claim 1, wherein the polysiloxane moiety is the major component of the S portion of the amphipathic copolymer.

11. The liquid electrophotographic toner composition according to claim 1, wherein the polysiloxane moiety is the S portion of the amphipathic copolymer.

12. The liquid electrophotographic toner composition according to claim 1, wherein the polysiloxane moiety is in the D material of the amphipathic copolymer.

13. The liquid electrophotographic toner composition according to claim 1, wherein the toner particle comprises at least one charge director.

14. The liquid electrophotographic toner composition according to claim 1, wherein the toner particle comprises at least one charge director in an amount effective to impart a negative electrical charge to the toner particles.

15. The liquid electrophotographic toner composition according to claim 1, wherein the toner particle comprises at least one charge director in an amount effective to impart a positive electrical charge to the toner particles.

16. A method for formation of a liquid electrophotographic toner composition, comprising:

a) providing a macromer having the general formula $$X(Y)_nSi(R)_{3-m}Z_m$$

wherein

X is a vinyl group that is copolymerizable with acrylate or methacrylate functionalities, Y is a divalent linking, n is zero or 1, m is an integer of from 1 to 3, R is hydrogen, lower alkyl, aryl, or alkoxy, and Z is a monovalent siloxane polymeric moiety having a number average molecular weight above about 500 and is essentially unreactive under copolymerization conditions; and b) reacting the macromer of step a) with (meth)acrylate monomers to form polymeric binder particles comprising at least one amphipathic copolymer comprising one or more S material portions and one or more D material portions, wherein the amphipathic copolymer comprises a polysiloxane moiety having molecular weight of at least about 500 Daltons;

c) forming toner particles comprising the polymeric binder particles of step b); and d) forming a liquid toner composition comprising a liquid carrier having a Kauri-butanol number less than 30 mL and a plurality of toner particles of step c).

17. The method of claim 16, wherein the macromer of step a) is further defined as having an X group which has the general formula

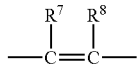

wherein $R^7$ is a hydrogen atom or a COOH group and $R^8$ is a hydrogen atom, a methyl group, or a $CH_2COOH$ group;

Y is a group of the formula —C(O)O—;

and Z has the general formula

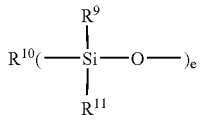

where $R^9$ and $R^{11}$ are independently lower alkyl, aryl, or fluoroalkyl, where lower alkyl and fluoroalkyl both refer to alkyl groups having from one to three carbon atoms and where aryl refers to phenyl or substituted phenyl;

$R^{10}$ is alkyl, alkoxy, alkylamino, aryl, hydroxyl, or fluoroalkyl;

and e is an integer from about 5 to about 700.

18. A method for formation of a liquid electrophotographic toner composition, comprising:

a) providing a prepolymer comprising a reactive functionality;

b) providing a macromer having the general formula $$A\text{-}Si(R)_{3-m}Z_m$$

wherein

A is a complementary reactive functionality that is reactive with the reactive functionality of the prepolymer of step a)' m is an integer of from 1 to 3,

R is hydrogen, lower alkyl, aryl, or alkoxy, and Z is a monovalent siloxane polymeric moiety having a number average molecular weight above about 500 and is essentially unreactive under copolymerization conditions; and c) reacting the prepolymer of step a) with the macromer of step b) to form polymeric binder particles comprising at least one amphipathic copolymer comprising one or more S material portions and one or more D material portions, wherein the amphipathic copolymer comprises a polysiloxane moiety having molecular weight of at least about 500 Daltons;

d) forming toner particles comprising the polymeric binder particles of step c); and e) forming a liquid toner composition comprising a liquid carrier having a Kauri-butanol number less than 30 mL and a plurality of toner particles of step d).

* * * * *